United States Patent [19]

Andrén

[11] Patent Number: 4,534,859

[45] Date of Patent: Aug. 13, 1985

[54] CLEANING MACHINE WITH A VERTICAL CYLINDER SCREEN

[75] Inventor: Ingmar Andrén, Lindesberg, Sweden

[73] Assignee: Lindema Kommanditbolag, Lindesberg, Sweden

[21] Appl. No.: 553,721

[22] Filed: Nov. 21, 1983

[30] Foreign Application Priority Data

Dec. 1, 1982 [SE] Sweden ..... 8206874

[51] Int. Cl.[3] ..... B07B 1/26

[52] U.S. Cl. ..... 209/301; 209/332; 209/366

[58] Field of Search ..... 209/148, 144, 301–304, 209/240, 255, 309, 331, 332, 367, 369, 366, 366.5, 243; 74/86

[56] References Cited

U.S. PATENT DOCUMENTS

| | | | |
|---|---|---|---|
| 304,967 | 9/1884 | Stanley et al. | 209/304 |
| 448,538 | 9/1891 | Monnier | 209/304 |
| 3,794,166 | 2/1974 | Converse et al. | 209/301 X |
| 4,265,738 | 5/1981 | Goncharov et al. | 209/301 X |

FOREIGN PATENT DOCUMENTS

| | | | |
|---|---|---|---|
| 0485784 | 12/1976 | U.S.S.R. | 209/301 |

*Primary Examiner*—Charles Hart

*Attorney, Agent, or Firm*—Karl W. Flocks; Sheridan Neimark; A. Fred Starobin

[57] ABSTRACT

The vertical cylinder screen in a cleaning machine is adapted to be given a rotary motion at oscillating angular velocity. This is obtained with this invention in that the cylinder screen is adapted to be given an oscillatory motion by means of a driven eccentric unit coupled to it and a rotary motion in that the eccentric unit is mounted on a carrier therefor which is adapted to rotate about the center shaft of the cylinder screen.

19 Claims, 6 Drawing Figures

CLEANING MACHINE WITH A VERTICAL CYLINDER SCREEN

The cleaning machines used at present have almost exclusively plane screens for cleaning which require large space in relation to the capacity. This disadvantage may be eliminated by using vertical rotary cylinder screens which by use of centrifugal force can give substantially increased capacity and thus require less space as compared to the plane screens. To permit vertical rotary cylinder screens to function satisfactorily it is necessary that they are adapted to be given a rotary motion with oscillatory angular velocity. It is only through the present invention that it has been possible to realize a drive unit for such motion, which drive unit satisfies high demands upon reliability in continuous operation. Characteristic of the cleaning machine according to the invention is that the cylinder screen is adapted to be given an oscillatory motion by means of a driven eccentric unit coupled to it and a rotary motion in that the eccentric unit is mounted on a carrier therefor which is adapted to rotate about the center shaft of the cylinder screens.

The invention will be described in more detail below with reference to the accompanying drawings which illustrate a preferred embodiment of the cleaning machine and in which.

Figure 1:
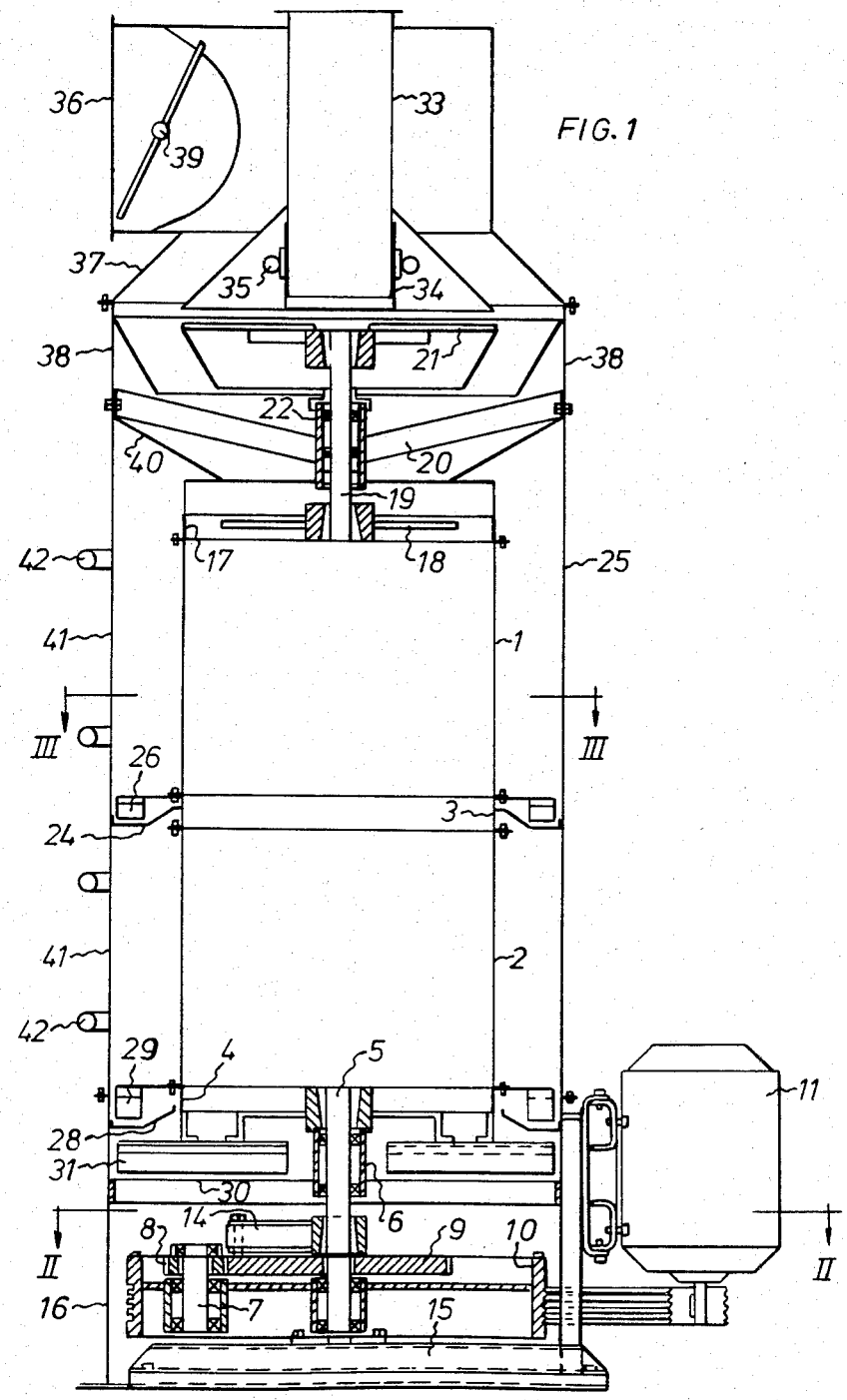
FIG. 1 is a longitudinal section of the cleaning machine.
Figure 2:
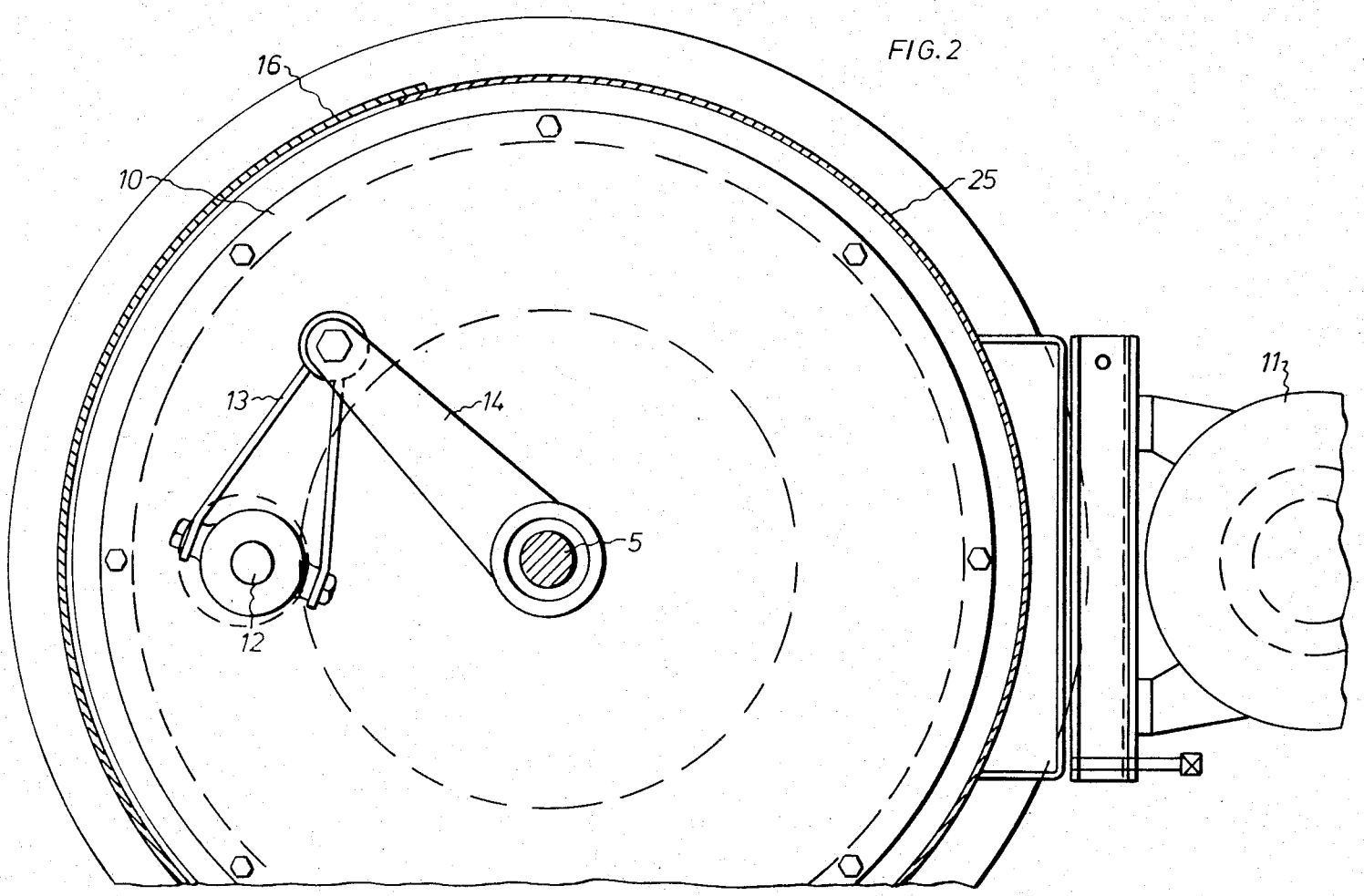
FIG. 2 is a cross-section of the cleaning machine on line II—II in FIG. 1.

A cylinder of perforated sheet metal is designated by 1 and this is provided with flanges at the ends and is secured in a flange ring 3 by means of bolts or screws. This ring 3 is screwed in the same way on a cylinder 2 which also consists of perforated sheet metal. The cylinder 2 is also screwed on a drive wheel 4 at its lower end flanges. This drive wheel 4 has at its center a downwardly extending shaft 5 mounted in a fixed bearing 6. The drive unit for the cylinder screen engages with the end of the shaft 5 reaching below the bearing 6.

The drive unit includes an eccentric shaft 7 which is fixed to a planet gearwheel 8. This planet gearwheel is in engagement with a permanently stationary gearwheel 9. These two gearwheels 8 and 9 are built with their shafts and bearings extending into a flywheel 10 so that the gearwheel 8 can rotate in an oil bath. The flywheel 10 is adapted to be driven by a motor 11 via driving belts.

One end of a first lever 13 is borne on the eccenter 12 on the eccentric shaft 7 and the other end of this lever is pivotally connected to one end of a second lever 14 the other end of which is fixedly connected to the shaft 5 of the cylinder screen. When the eccentric shaft 7 rotates with the rotation of gearwheel 8 it imparts via the levers 13 and 14 an oscillatory motion to the cylinder screen. As the eccentric shaft 7 also is adapted to rotate with the flywheel 10 about the shaft 5 it also imparts a rotary motion to the cylinder screen.

The driving belts for the flywheel 10 may be pushed in into a slit underneath a beam designated by 15. The flywheel 10 with the planet gearwheel 8 may be mounted through a door at 16.

Figure 6:
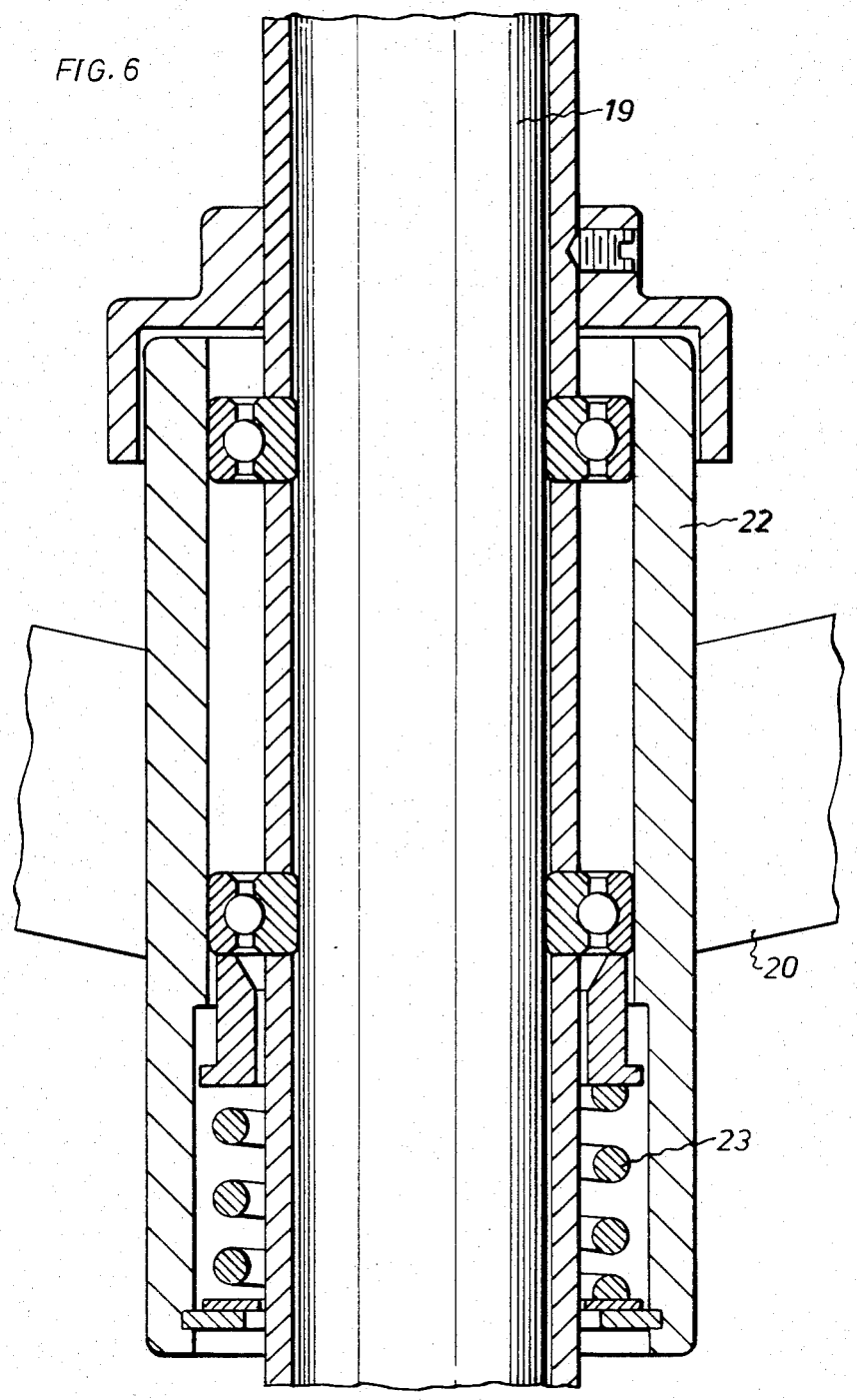
FIG. 6 shows in longitudinal section and on a large scale a bearing device included in the cleaning machine.

The upper flange on the cylinder 1 is screwed on to a wheel 17 which has a distributor disc 18 fixed on its spokes. The wheel 17 is mounted to a spider 20 via a shaft 19. Fixed to the upper end of the shaft 19 is a distributor disc 21. The bearing 22 for the shaft 19 is best shown in FIG. 6. This is displaceable by about 5 mm in the vertical sense under the action of a spring 23. Mounting or removing e.g. the upper cylinder 1 is facilitated in that the wheel 17 rises as soon as a flange connection is loosened.

The cleaning material passing through the cylinder screen 1 falls down on a sheet metal ring 24 which is situated between the cylinder screen 1 and an outer cylinder 25. The material is fed out by means of feed vanes 26 through the outlet opening 27, as appears from FIG. 3. The material passing through the cylinder screen 2 falls down on a sheet metal ring 28 and is fed out by feed vanes 29. The material passing over the cylinder screen 2 falls down on the bottom 30 and is fed out through an outlet opening by means of feed vanes 31.

Figure 3:
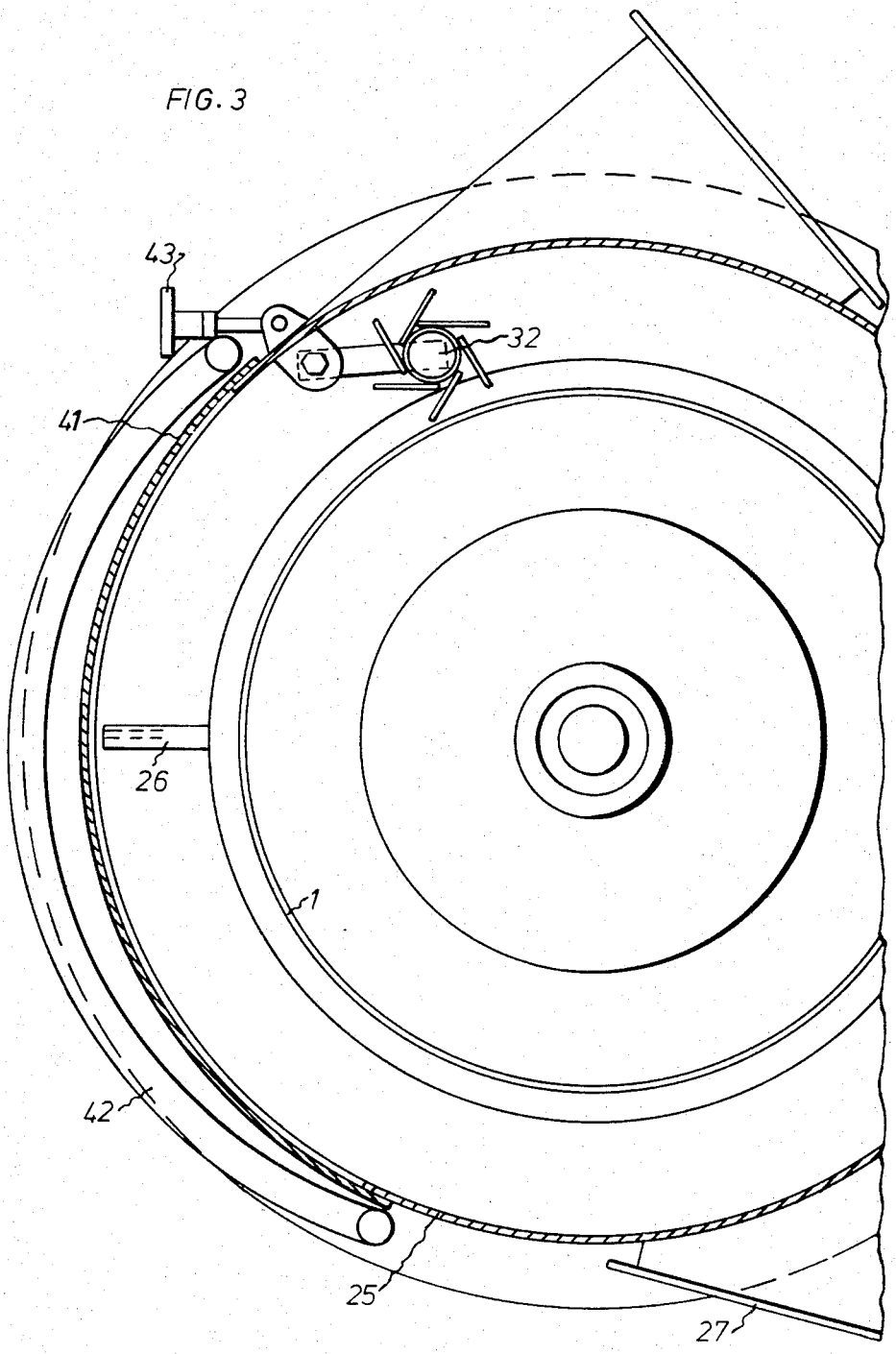
FIG. 3 is a cross-section of the cleaning machine on line III—III in FIG. 1.
Figure 4:
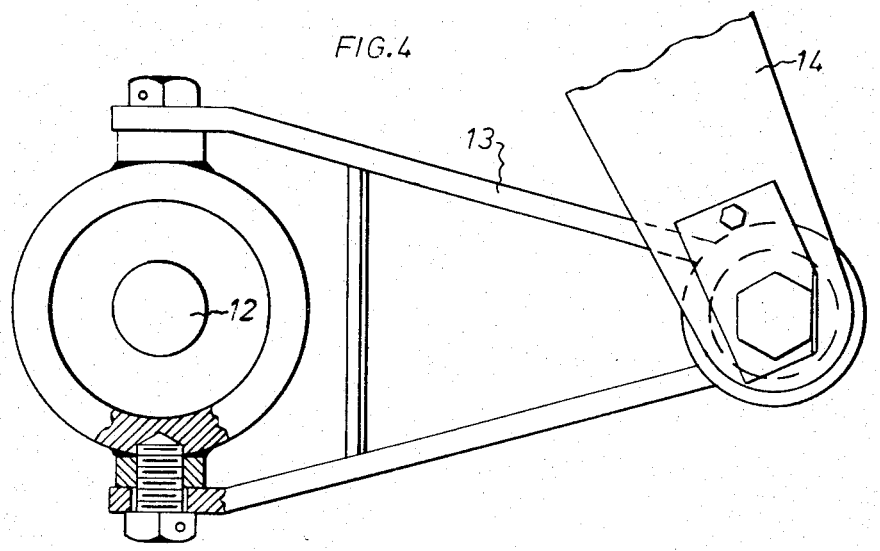
FIGS. 4 and 5 are respectively a top view and a side view, partly in section, of the eccentric unit and a pair of levers joined to it.
Figure 5:
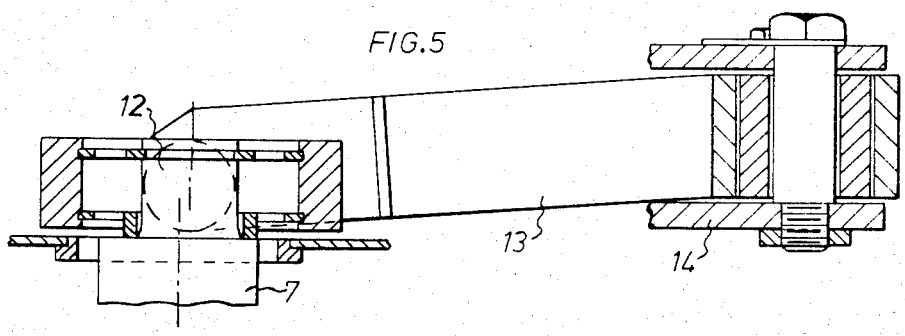

The cylinder screens are kept clean by means of cleaning rollers 32, as appears from FIG. 3.

A feed pipe for ingoing material is designated by 33. A pipe 34 is slidable on the pipe 33 and can be raised and lowered by means of a rack mechanism 35 relative to the distributor disc 21. An opening for connection of a suction fan is designated by 36. An annular duct, designated by 37, is in communication with the opening 36. A number of openings, designated 38, are arranged around the periphery of the outer cylinder for admission of air for air-cleaning of the material.

To unloaden the perforated screen cylinder from torsional moments it may be provided with a core consisting of a rigid cylinder of a diameter substantially less than that of the screen cylinder. The rigid cylinder must be connected at its ends with the ends of the screen cylinder by means of ring-shaped plates which do not prevent feeding of cleaning material. For this purpose the outer periphery of the plates is star-shaped.

To allow the cleaning material to move spirally down through the screen cylinder this may be provided with a stationary screw which gives a better distribution of cleaning material and an increased capacity due to the positive feeding.

MODE OF MOTION OF THE SCREEN CYLINDER

When the flywheel 10 rotates the gearwheel 9 stands still. The planet gearwheel 8 must then rotate and so must the eccentric shaft 7. The levers 13 and 14 then move to and fro and compel the screen cylinder to follow the same movement at the same time as it rotates with the same number of revolutions per unit of time as the flywheel 10. The screen cylinder will rotate at an oscillating speed despite the fact that the flywheel 10 rotates at constant angular velocity. The gear ratio of the motor 11 to the flywheel 10 is calculated so that the screen cylinder rotates at about 190 rpm. The gravity of the material in the screen cylinder will thus increase approximately 12 times. The gear ratio of the flywheel 10 to the eccentric shaft 7 may be, say, 1:4, whereby the rotational speed of the eccentric shaft 7 will be 760 rpm. The eccentricity should be about 3 mm whereby the amplitude of the periphery of the screen cylinder will be about 7 mm. Thus, with this system it is possible to obtain any amplitude and frequency desired at a certain rotational speed.

MODE OF OPERATION OF THE MATERIAL ON ITS WAY THROUGH THE MACHINE

The material is fed in through the pipe 33 and the inflow quantity is regulated by means of the pipe 34 being raised or lowered with the aid of the control device 35.

The material is thrown out horizontally by the rotary disc 21 which is provided with radial cams. The circular inlet opening 36 is connected to a suction fan and the air quantity is regulated by the throttle 39. Air passes through the inlet openings 38 into and up through the annular duct 37 where the air will thus twice meet the material to be air-cleaned. The material then falls down on a funnel 40 and is guided down on the underlying rotary disc 18 which is designed in the same manner as the upper disc 21. The disc 18 throws the material out towards the cylinder part of the wheel 17. Under influence of the centrifugal force the material is pressed up around the periphery of the cylinder part of the wheel 17. When the screen cylinder rotates with oscillatory angular speed and the frequency of the oscillation is chosen sufficiently high the material will move in zigzag downwards along the cylinder screens. The material passing through the screen cylinder 1 falls down on the annular plate 24 and is fed out by the feed vanes 26 through an outlet opening. The material which does not pass through the screen cylinder 1 continues to pass into the screen cylinder 2. The material passing through this screen falls down on the annular plate 28 and is fed out by the feed vanes 29 through an outlet opening. The material not passing through the screen cylinder 2 falls down on the bottom 30 and is fed out by the feed vanes 31 through an outlet opening.

EXCHANGE OF SCREENS AND DOORS FOR ACCESS TO THE SCREENS

When screens are to be possible to have access to them through doors 41 in the outer cylinder 25. As appears from FIG. 3 each door 41 consists of a relatively thin bow-shaped sheet plate the ends of which are secured to a frame 42 of two straight and two bow-shaped tubes. Due to this design the thin sheet plate will adapt itself to the periphery of the outer cylinder 25 so that a good seal is obtained when the door 41 is tightened with the hand wheels 43.

When all the screens are to be disassembled or mounted the process is as follows. One starts preferably by disassembling all the screws in the upper flange of the cylinder screen 1. When this has been done the ring 17 will rise about 5 mm with the aid of the spring 23. Thanks to this it now is easy to pull out the cylinder screen 1 after the screws in the lower flange of the screen 1 have been removed. After this the cylinder screen 2 may be removed in the same way.

When remounting screens one preferably starts with the cylinder screen 2. One holds up the flange ring 3 with one hand and with the other hand one inserts the cylinder screen 2. The cylinder 2 is turned so that the screw holes tally and the screws are mounted. Now it is possible to push in the cylinder screen 1 and the lower flange ring is mounted. Finally the flange ring 17 is pulled down against the action of the spring 23 and the upper screws are mounted. A condition for the mounting now described has been that the shafts 5 and 19 for the rotation of the cylinder screen are located outside the cylinder screen, as appears from FIG. 1. Thus, in the construction shown the cylinder screen is part of a coherent drive system.

According to the invention a cleaning machine has been obtained in which the motor 11 via the flywheel 10 drives the cylinder screen as well as the discs 21 and 18 for feeding of the cleaning material into the aircleaning duct and the cylinder screen and also the feed-out means 26, 29 and 31 for cleaned-out fractions.

The cleaning machine according to the invention is of such a design that it is easy to increase the number of cylinder screens from two to at least three. It is also possible to design the cleaning machine so that the driving unit will be located above the upper cylinder screen 1 instead of below the lower cylinder screen 2, as in the drawings.

The invention is not restricted to that described above and shown in the drawings but may be modified within the scope of the appended claims.

What I claim and desire to secure by Letters Patent is:

1. A cleaning machine comprising a center shaft (5), a vertical cylinder screen (1–3) connected to said center shaft for rotation with said center shaft, a driven eccentric means connected to said center shaft to give said screen an oscillatory angular motion, carrier means mounted for rotation about said center shaft to give a rotary motion to said vertical cylinder screen, said carrier means including a disc (10) which is rotatable about said center shaft and having a driving means (11) connected to said disc to rotate said disc, said driven eccentric means including an eccentric unit shaft (7) carried by said disc for rotation relative to said disc, an eccentric (12) on said eccentric unit shaft, a gearwheel (8) fixedly mounted on said eccentric unit shaft, and a stationary gearwheel (9) mounted around said center shaft in a position to engage said gearwheel (8) on said eccentric unit shaft.

2. A cleaning machine as claimed in claim 1 wherein a first lever (13) has one end borne on said eccentric (12), a second lever (14) has one end pivotally connected to the other end of said first lever and the other end of said second lever fixedly connected to said center shaft (5) which said shaft is fixedly connected to said cylinder screen (1–3).

3. Cleaning machine as claimed in claim 2, wherein the center shaft (5) fixedly connected to the cylinder screen (1–3) is provided with a drive wheel (4) fixedly arranged thereon for the cylinder screen (1–3) which is connected to the drive wheel (4), at the periphery thereof, by means of screw or bolt connections.

4. Cleaning machine as claimed in claim 3, wherein the cylinder screen (1–3) at its end remote from the drive wheel (4) is connected, by means of a screw or bolt connection, with a wheel (17) at the periphery thereof, said wheel (17) being provided with a shaft (19) which is fixedly connected to it and adapted to rotate with the cylinder screen (1–3).

5. Cleaning machine as claimed in claim 4, wherein the wheel (17) at the end of the cylinder screen (1–3)

remote from the drive wheel (4) and the shaft (19) connected thereto are provided with distributor discs (18, 21) for the cleaning material.

6. Cleaning machine as claimed in any of claim 3, wherein feed-out vanes (31) are arranged on the drive wheel (4).

7. Cleaning machine as claimed in claim 3, wherein feed means (26, 29) are arranged at the periphery of the cylinder screen (1–3).

8. Cleaning machine as claimed in claim 4, wherein the shaft (19) of the wheel (18) at the end of the cylinder screen (1–3) remote from the drive wheel (4) is displaceably borne and acted upon by a spring (23) which tends to displace it in a direction away from the cylinder screen (1–3).

9. Cleaning machine as claimed in claim 2, wherein the shafts (5, 19) for rotation of the cylinder screen (1–3) are located outside the cylinder screen (1–3) whereby said screen is removable in the lateral sense after the screw or bolt connections have been loosened.

10. Cleaning machine as claimed in claim 4, wherein feed-out vanes (31) are arranged on the drive wheel (4).

11. Cleaning machine as claimed in claim 5, wherein feed-out vanes (31) are arranged on the drive wheel (4).

12. Cleaning machine as claimed in claim 6, wherein feed means (26,29) are arranged at the periphery of the cylinder screen (1–3).

13. Cleaning machine as claimed in claim 11, wherein feed means (26,29) are arranged at the periphery of the cylinder screen (1–3).

14. Cleaning machine as claimed in claim 5, wherein the shaft (19) of the wheel (18) at the end of the cylinder screen (1–3) remote from the drive wheel (4) is displaceably borne and acted upon by a spring (23) which tends to displace it in a direction away from the cylinder screen (1–3).

15. Cleaning machine as claimed in claim 3, wherein the shafts (5, 19) for rotation of the cylinder screen (1–3) are located outside the cylinder screen (1–3) whereby said screen is removable in the lateral sense after the screw or bolt connections have been loosened.

16. Cleaning machine as claimed in claim 5, wherein the shafts (5, 19) for rotation of the cylinder screen (1–3) are located outside the cylinder screen (1–3) whereby said screen is removable in the lateral sense after the screw or bolt connections have been loosened.

17. Cleaning machine as claimed in claim 6, wherein the shafts (5, 19) for rotation of the cylinder screen (1–3) are located outside the cylinder screen (1–3) whereby said screen is removable in the lateral sense after the screw or bolt connections have been loosened.

18. Cleaning machine as claimed in claim 8, wherein the shafts (5, 19) for rotation of the cylinder screen (1–3) are located outside the cylinder screen (1–3) whereby said screen is removable in the lateral sense after the screw or bolt connections have been loosened.

19. Cleaning machine as claimed in claim 13, wherein the shafts (5, 19) for rotation of the cylinder screen (1–3) are located outside the cylinder screen (1–3) whereby said screen is removable in the lateral sense after the screw or bolt connections have been loosened.

* * * * *